United States Patent [19]

Larouche

[11] Patent Number: 4,911,755

[45] Date of Patent: Mar. 27, 1990

[54] METHOD FOR THE REFINING OF LEAD

[75] Inventor: Gerald R. Larouche, Trail, Canada

[73] Assignee: Cominco Ltd., Vancouver, Canada

[21] Appl. No.: 399,196

[22] Filed: Aug. 28, 1989

[51] Int. Cl.[4] ..... C22B 13/06

[52] U.S. Cl. ..... 75/78; 75/93 DA

[58] Field of Search ..... 75/78, 93 DA

[56] References Cited

U.S. PATENT DOCUMENTS 4,042,228 8/1977 Ward et al. ..... 75/78

FOREIGN PATENT DOCUMENTS 2144604 2/1973 France ..... 75/78
98637 6/1982 Japan ..... 75/78
2033728 2/1987 Japan ..... 75/78
496312 4/1976 U.S.S.R. ..... 75/78

*Primary Examiner*—Melvyn J. Andrews
*Attorney, Agent, or Firm*—Arne I. Fors; D. Doak Horne

[57] ABSTRACT

Lead that forms dross upon melting is refined by treatment with refining agents consisting essentially of calcium metal and aluminum-silicon eutectic alloy. The refining agents are mixed into a bath of molten lead preferably at 600° C., the bath is cooled to preferably 450° C., and sodium hydroxide and sodium nitrate are added to remove the refining agents. The formed dross is skimmed and refined lead is recovered. The refined lead forms less dross upon remelting.

8 Claims, No Drawings

METHOD FOR THE REFINING OF LEAD

This invention relates to the refining of lead and, particularly, to a method for the refining of lead for reducing the amount of dross formed on remelting.

BACKGROUND OF THE INVENTION

Numerous methods are known for the refining of lead bullion that is made by the various smelting processes for the recovery of lead from ores and concentrates. The refining is necessary for the removal of impurities which include antimony, arsenic, bismuth, copper, iron, selenium, silver, tellurium, tin, zinc, gold and other metals, and which impurities may be present in varying amounts. A great number of refining processes are known. These processes include electrorefining processes, and processes wherein metals and alloys are used. In the electrorefining process, the lead bullion electrodes contain certain amounts of arsenic and antimony that are necessary for preventing slime from falling off the electrodes. Although electrorefining removes most of the impurities from the lead, and the electrorefined lead meets the specifications for purity, the small amount of impurities remaining, usually less than 0.1% total, causes undesirable formation of dross when the electrorefined lead is remelted.

BRIEF DESCRIPTION OF PRIOR ART

The refining of lead by treating molten lead with metals or alloys is well documented. According to most of these refining treatments, molten lead is contacted with suitable metals or alloys for the formation of dross of alloys or compounds of the added metals or alloys with the impurities in the lead. The dross is separated, and refined lead is recovered. According to the numerous patents on lead refining, the metals and alloys used in refining include calcium, barium, magnesium, zinc, sodium, lithium, potassium, aluminum, aluminum-tin alloy, aluminum-zinc alloy, calcium-lead alloy, and calcium and magnesium. Residuals of the added metals and alloys are often removed by adding a suitable drossing agent such as ammonium chloride, sodium or potassium hydroxide, phosphorus, sulfur, coal, a halide, or air.

The oxidation of molten lead affects its refining and the degree of drossing. It has been determined that certain impurities in or additives to stationary or moving melts of lead accelerate or reduce the rate of oxidation, while some have little effect. Lithium, sodium, calcium, magnesium, arsenic, antimony, copper, silver and tellurium increase the rate, aluminum and tin reduce the rate, and bismuth, cadmium and zinc have little effect on the rate (Lead Handbook, ed. Heubner et al., Metallgesellschaft AG, Frankfurt, 1983). The reduction of the oxidation of lead with aluminum has been investigated by Krysko (Krysko W. W., Oxidation of molten lead, Third International Conference of Lead, Venice, September 1968). According to Canadian Pat. No. 1 204 596, deoxidation of molten metal (steel) is accomplished with a refining agent essentially consisting of calcium and at least one of aluminum and silicon, and a flux composed mainly of calcium and aluminum oxides, the alloy and the flux being integrally bonded to one another. It is disclosed that an aluminum-silicon alloy may be used in the calcium alloy. The use of the aluminum-silicon eutectic alloy and its oxidation inhibiting effect in the manufacture of lead alloys for storage batteries are known from German Patent DE 27 46 713 Al.

SUMMARY OF THE INVENTION

It has now been found that molten lead may be refined by a treatment with refining agents consisting essentially of calcium metal and aluminum-silicon eutectic alloy. More specifically, we have found that when molten lead is treated with calcium metal and aluminum-silicon eutectic alloy and the resulting melt is treated with sodium compounds, a dross is formed, and a refined lead is recovered that contains less than 0.0001% of combined calcium, aluminum and silicon (<1 ppm), and that reduces the amount of dross formed upon remelting.

It is an object of the present invention to provide a method for the refining of lead. It is another object to provide a method for reducing the amount of dross formed upon remelting of lead. These and other objects of the invention will become clear from the following detailed description.

Accordingly, there is provided a method for the refining of lead that forms dross upon melting which comprises the steps of forming a bath of molten lead; heating said bath to a temperature in the range of about 585° to 620° C.; adding to the heated bath effective amounts of refining agents consisting essentially of calcium metal and aluminumsilicon eutectic alloy, said effective amounts being sufficient to effectively reduce the amount of dross formed upon remelting of the solidified lead recovered from said method; when said refining agents are substantially completely dissolved, allowing said bath to cool to a temperature in the range of about 375° to 475° C.; adding suitable amounts of sodium hydroxide and sodium nitrate to said bath for the substantial removal of said refining agents in a dross with the formation of refined lead and a layer of dross on the bath; skimming said dross from the bath; and recovering solidified refined lead that forms a reduced amount of dross upon remelting.

DETAILED DESCRIPTION

Lead that forms dross upon melting is added in molten form to a suitable vessel to form a bath of molten lead therein. The lead that forms dross upon melting may be, for example, lead that has been refined by the Betts process or other refining processes. Other lead that is subject to excess dross formation upon melting may also be treated by the method according to the invention. Any dross on the bath of molten lead in the vessel is removed, and the bath is heated to a temperature that is somewhat above the melting temperature of the to-be-added aluminum-silicon eutectic alloy. A convenient temperature is in the range of about 585° to 620° C. The preferred temperature is about 600° C., allowing rapid dissolution of refining agents. Effective amounts of refining agents, consisting essentially of calcium metal and aluminum-silicon eutectic alloy, are added to the heated bath, and are submerged therein until molten. The bath is agitated to ensure rapid and complete dissolution of the refining agents. The refining agents are preferably loaded into a perforated basket that is subsequently submerged in the bath. Pieces, chunks, bars or other suitable forms of calcium metal and aluminumsilicon eutectic alloy are loaded in the basket such that the alloy is substantially surrounded by calcium. When the loaded basket is submerged in the bath of molten lead, the strongly exothermic reaction of calcium with lead causes rapid melting of the calcium and the eutectic alloy. The eutectic alloy contains about 12.0 to 12.5% silicon, and melts at about 575° to 580° C. The required amounts of refining agents are small, but should be effective in reducing the amounts of dross formed upon remelting of the solidified lead recovered according to the method of the invention. Effective amounts are, for example, an amount of calcium in the range of about 0.03 to 0.09% and an amount of aluminum-silicon eutectic alloy in the range of about 0.01 to 0.04% by weight of the amount of lead being treated in the bath of molten lead. The preferred amounts are about 0.06% calcium and about 0.03% aluminum-silicon eutectic alloy. When the refining agents are substantially completely dissolved the basket is removed from the vessel, and the bath is allowed to cool to a temperature in the range of about 375° to 475° C. Cooling to a temperature of about 450° C. is preferred, as at this temperature refined lead may be cast conveniently. The bath is then treated for the substantial removal of the refining agents from the refined lead in a dross. Suitable amounts of sodium hydroxide and sodium nitrate are added to the bath while the bath is being agitated with the formation of refined lead and the formation of a layer of dross on the surface of the bath. Additions of sodium hydroxide and sodium nitrate are continued until a skilled operator judges by visual observations that the refined lead has the right appearance. Agitation is then stopped, the agitator is removed from the bath, and the dross is skimmed from the surface of the bath. The refined lead is subsequently poured into moulds and solidified. The solidified refined lead is recovered. Upon remelting, the recovered solidified lead forms an amount of dross that is reduced, and is considerably less than the amount formed on remelted lead not treated according to the method of the present invention.

The invention will now be illustrated by means of the following non-limitative example.

EXAMPLE 177 metric tones of lead from the Betts electrorefining process were melted and added to a kettle. Dross was skimmed, and the lead was heated to 600° C. 113 kg of calcium metal and 45 kg of aluminum-silicon eutectic alloy were loaded as refining agents in a wire mesh basket, alloy being substantially surrounded by calcium, and the loaded basket was submerged in the bath. The bath was agitated, drawing a slight vortex. Dissolution was completed in ten minutes. The basket was withdrawn from the bath, and the bath was allowed to cool to 450° C. Portions of sodium hydroxide and sodium nitrate were then added to the bath, while the bath was being agitated. Additions and agitation were continued until the operator judged visually that the refined lead had the right appearance, the refining agents at that time having been substantially removed from the refined lead into a dross. The dross was skimmed, and refined lead was cast into moulds and solidifed. The solidified lead was sampled and found to contain less than one part per million of combined calcium, aluminum and silicon. 32 metric tonnes of the solidified lead were remelted and the dross formed on the surface of the remelted lead was removed and weighed. The amount of dross was 0.2% of the weight of the refined lead. In a parallel test, it was determined that lead recovered from the Betts electrorefining process and remelted produced 0.4% of its weight in dross. The results show that the method according to the invention produces a refined lead that upon melting forms half the amount of dross of lead not so refined, and that the treatment with sodium compounds effectively removes the refining agents from the refined lead.

It is understood that variations may be made in the method according to the invention without departing from the scope and purview of the appended claims.

I claim:

1. A method for the refining of lead that forms dross upon melting which comprises the steps of forming a bath of molten lead; heating said bath to a temperature in the range of about 585° to 620° C.; adding to the heated bath effective amounts of refining agents consisting essentially of calcium metal and aluminum-silicon eutectic alloy, said effective amounts being sufficient to effectively reduce the amount of dross formed upon remelting of the solidified lead recovered from said method; when said refining agents are substantially completely dissolved, allowing said bath to cool to a temperature in the range of about 375° to 475° C.; adding suitable amounts of sodium hydroxide and sodium nitrate to said bath for the substantial removal of said refining agents in a dross with the formation of refined lead and a layer of dross on the bath; skimming said dross from the bath; and recovering solidified refined lead that forms a reduced amount of dross upon remelting.

2. A method as claimed in claim 1, wherein said effective amounts are an amount of calcium in the range of about 0.03% to 0.09% by weight of the lead in said bath of molten lead and an amount of said eutectic alloy in the range of about 0.01% to 0.04% by weight of the lead in said bath of molten lead.

3. A method as claimed in claim 1, wherein said lead that forms dross upon melting is electrorefined lead.

4. A method as claimed in claim 1, wherein said effective amounts of refining agents are loaded in a basket such that said eutectic alloy is substantially surrounded by calcium; the loaded basket is submerged in said bath; and said bath is agitated until said refining agents are dissolved in said bath.

5. A method as claimed in claim 1, wherein said effective amounts are an amount of calcium of about 0.06% by weight of the lead in said bath of molten lead and an amount of said eutectic alloy of about 0.03% by weight of the lead in said bath of molten lead.

6. A method as claimed in claim 3, wherein said effective amounts are an amount of calcium of about 0.06% by weight of the lead in said bath of molten lead and an amount of said eutectic alloy of about 0.03% by weight of the lead in said bath of molten lead.

7. A method as claimed in claim 4, wherein said effective amounts are an amount of calcium of about 0.06% by weight of the lead in said bath of molten lead and an amount of said eutectic alloy of about 0.03% by weight of the lead in said bath of molten lead.

8. A method as claimed in claim 5, wherein said bath is heated to a temperature of about 600° C., and said bath is cooled to a temperature of about 450° C.

* * * * *